US006336643B1

(12) United States Patent
Wu

(10) Patent No.: US 6,336,643 B1
(45) Date of Patent: Jan. 8, 2002

(54) JUMP SKATE

(75) Inventor: Thomas J. Wu, McLean, VA (US)

(73) Assignee: American Composites Corporation, McLean, VA (US)

( * ) Notice: Subject to any disclaimer, the term of this patent is extended or adjusted under 35 U.S.C. 154(b) by 0 days.

(21) Appl. No.: 09/562,759

(22) Filed: May 2, 2000

Related U.S. Application Data

(63) Continuation-in-part of application No. 09/159,571, filed on Sep. 24, 1998, now Pat. No. 6,065,759.

(51) Int. Cl.[7] ..... A63C 1/00

(52) U.S. Cl. ..... 280/11.115; 280/11.224; 280/11.225; 280/11.27

(58) Field of Search ..... 280/11.115, 11.224, 280/11.225, 11.26, 11.27, 11.28

(56) References Cited

U.S. PATENT DOCUMENTS

| | | | | | |
|---|---|---|---|---|---|
| 942,333 | A | * | 12/1909 | Lennox | 280/11.115 |
| 999,660 | A | * | 8/1911 | Koppel | 280/11.115 |
| 1,150,966 | A | * | 8/1915 | Ries | 280/11.224 |
| 1,338,813 | A | * | 5/1920 | Chiarelli | 280/11.115 |
| 1,597,792 | A | * | 8/1926 | Hoff et al. | 280/11.115 |
| 2,174,990 | A | * | 10/1939 | Maguire | 280/11.115 |
| 4,351,538 | A | * | 9/1982 | Berts | 280/11.26 |
| 4,451,055 | A | * | 5/1984 | Lee | 280/11.115 X |
| 5,503,413 | A | * | 4/1996 | Belogour | 280/11.27 |
| 5,823,543 | A | * | 10/1998 | Burns et al. | 280/11.28 |
| 6,039,329 | A | * | 3/2000 | Burns et al. | 280/11.28 |
| 6,065,763 | A | * | 5/2000 | Adams, Jr. | 280/11.28 |

FOREIGN PATENT DOCUMENTS

| | | | | |
|---|---|---|---|---|
| DE | 3730839 | * | 3/1989 | 280/11.115 |

* cited by examiner

*Primary Examiner*—Michael Mar
(74) *Attorney, Agent, or Firm*—Mattingly, Stanger & Malur, P.C.

(57) ABSTRACT

A jump skate comprises a boot with a base attachment, a surface engager, and a link/spring mechanism, which uses large spring deformation to boost a skater in jumping. The link/spring mechanism comprises at least two links and at least one spring (coil or wound). The links and the spring(s) are made of metallic, synthetic, or composite materials. The link/spring mechanism is connected to the boot and the surface engager with pin joints in such a way that allows large relative displacement with zero rotation between the boot and the surface engager, which offers improved control of the surface engager for skate jump/landing. The spring(s) is installed in such a way that it deforms with relative displacements between the boot and the surface engager. Thus a skater can first store energy into the spring(s) by forcing the boot down towards the surface engager and then jump to release the energy for further height.

9 Claims, 8 Drawing Sheets

JUMP SKATE

CROSS-REFERENCE TO RELATED APPLICATION

This is a continuation-in-part application of U.S. patent application Ser. No. 09/159,571 filed on Sep. 24, 1998 now U.S. Pat. No. 6,065,759.

BACKGROUND OF THE INVENTION

1. Field of the Invention

The present invention relates to a skate for jumping. More particularly, the invention relates to improved in-line roller skates, improved ice skates, and improved conventional roller skates, which provide effective energy storage/release to enable a relatively high jump, controlled landing, and reduced impact.

2. Description of the Related Art

Spring-assisted skates are disclosed in the patent art. Most of these prior arts use small springs and claim shock absorbing characteristics. only a couple of prior arts claim jump-assisting characteristics. Such skates are disclosed in U.S. Pat. No. 1,597,792 issued to E. A. Hoff et al (1926); U.S. Pat. No. 4,351,538 issued to Berta (1982); and U.S. Pat. No. 5,503,413 issued to Belogour (1996). These prior arts include an ice skate, a conventional roller skate, and an in-line roller skate. Each of the skates comprises components including a boot, a surface-engaging blade or roller assembly (hereinafter referred to as the surface engager), and a means using spring(s) for shock absorbing or jump assistance.

In general, these prior spring-assisted skates have the following disadvantages:

(a) No effective rotational control of the surface engager from the boot. In particular, the surface engager is allowed to rotate with respect to the boot, thus a skater cannot select a specific part of the surface engager to initiate a jump or support a landing. In other words, a skater's jump is limited to certain ways, and the landing becomes more difficult because of the uncertain orientation of the surface engager.

(b) No significant storage/release of energy to assist a jump because only small spring deformation is practical for these prior arts. Based on their design configurations, prior arts may further lose control of surface engagers and skate structural integrity if relatively large spring deformation is adopted.

Other spring-assisted prior arts related to self-propelling skates are disclosed in U.S. Pat. No. 4,451,055 issued to Robert E. Lee (1984) and U.S. Pat. No. 2,174,990 issued to F. R. Maguire (1939). These arts fall into the following disadvantages:

(a) Lack of jump assistance: These prior arts utilize the energy from the weight force entirely for forward propulsion, not jump assistance. A spring means may be used to bias the boot from the surface engager only when a skate (or weight carrier) is manually raised off the ground. Because a strong spring will create strong resistance and defeat the main purpose of propelling, only soft springs may or may not be used, which is apparently incapable of jump assistance.

(b) Hazardous for landing: These prior arts are not intended for jumping, and will definitely be hazardous in landing. Upon landing, these skates will propel and accelerate forward as the arts intend, thus making it virtually impossible for a skater to maintain balance.

SUMMARY OF THE INVENTION

Accordingly, objects and unique advantages of the present invention are:

1. to provide a spring-assisted skate with large spring deformation for effective jump assistance;
2. to provide a spring-assisted skate with zero rotation between the surface engager and the boot for effective jump/landing control;
3. to provide a spring-assisted skate with structural integrity during large deformation.

These and other objects of the invention are realized by interposing a link/spring mechanism between the boot and the surface engager.

A link/spring mechanism comprises at least two links and at least one spring (coil or wound). The links and spring(s) are made of metallic (such as aluminum alloy), synthetic (such as plastics), or composite materials (such as graphite/epoxy).

The link/spring mechanism is connected to the boot and the surface engager with pin (also made of metallic, synthetic, or composite materials) joints in such a way that i. the spring(s) deforms with relative displacements between the boot and the surface engager;

ii. the boot base is maintained parallel to the surface engager throughout the entire range of skate deformation.

Thus a skater can force the boot down towards the surface engager to store energy and then jump to release the energy for increased height. Being certain that the surface engager is parallel to the boot base, the skater can land with as much control as if wearing a regular skate even more comfortably due to the effective shock-absorbing characteristics of the jump skate.

Other objects, features and advantages of the invention shall become apparent from the following detailed description of the preferred embodiments thereof, when considered in conjunction with the drawings wherein like reference characters refer to corresponding parts in the several views.

BRIEF DESCRIPTION OF THE DRAWING

FIGS. 4(*c*) and 4(*d*) show alternative spring provisions for the embodiment shown in FIG. 4(*a*).

DETAILED DESCRIPTION OF THE PREFERRED EMBODIMENTS

1. First Preferred Embodiment

Jump skates according to the first preferred embodiment of the invention shall now be described with initial reference to FIGS. 1(*a*)–3(*b*)

Figures 1A, 1B:
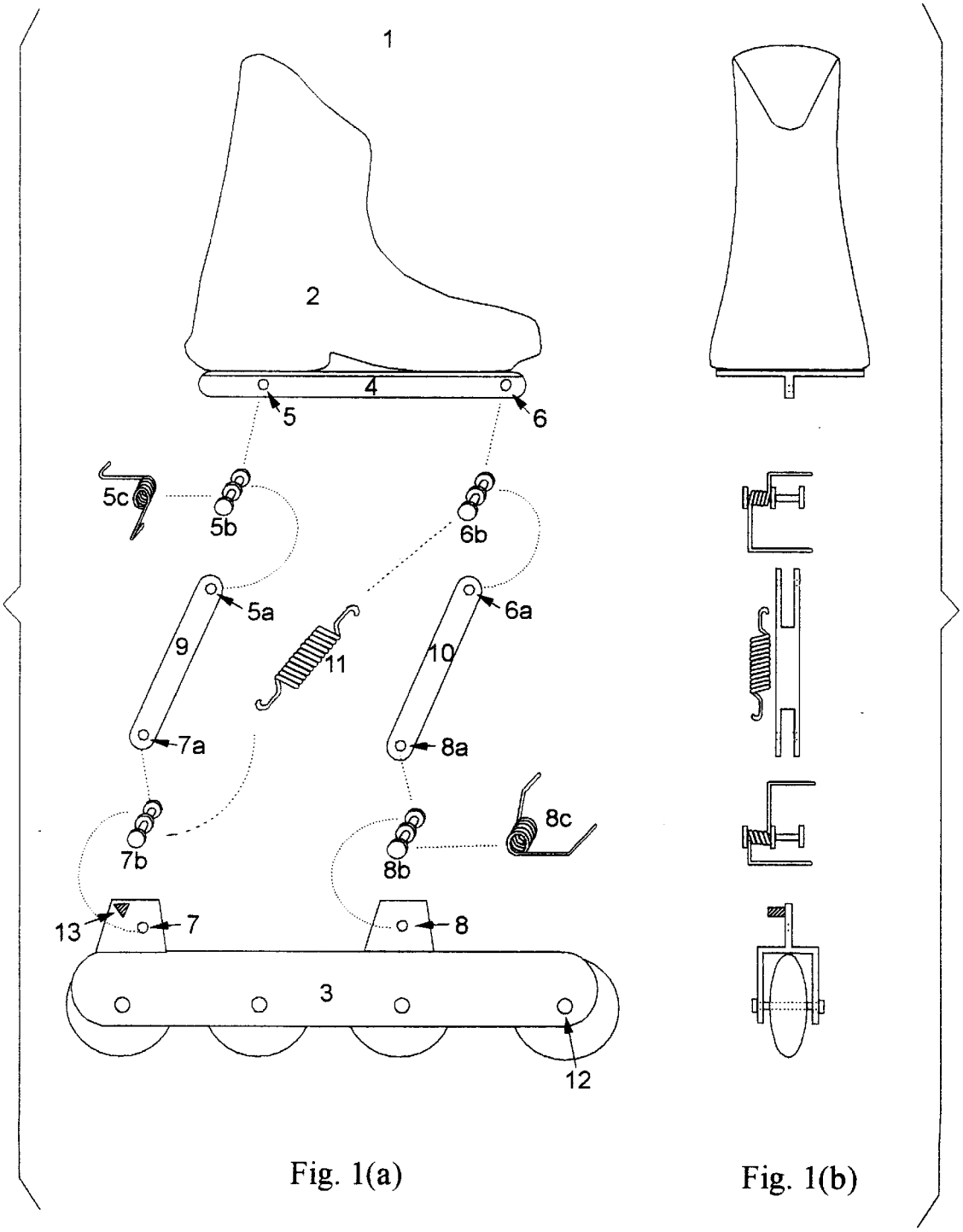
FIGS. 1(*a*) and 1(*b*) are exploded perspectives illustrating the side and front views, respectively, of the first preferred embodiment of the present invention related to a jump in-line roller skate using three springs.

As shown in FIGS. 1(*a*) and 1(*b*), jump skate 1 includes a boot 2 and an in-line roller assembly as the surface engager 3. Boot 2 includes a base attachment 4 with two machined holes 5 and 6. (A base attachment may comprise a single element or multiple elements that are attached to the sole and heel with screws, adhesive, or other means.) Surface engager 3 includes attachments with two machined holes 7 and 8. The distance between holes 5 and 6 is the same as that between holes 7 and 8.

Shown between the boot base attachment 4 and the surface engager 3 is the link/spring mechanism that comprises Links 9 and 10 (of equal length) with four machined holes 5*a*, 6*a*, 7*a*, and 8*a*

Connector pins 5*b*, 6*b*, 7*b*, and 8*b*

Wound springs 5*c* and 8*c*

Coil spring 11.

Pins 5*b*, 6*b*, 7*b*, and 8*b* are shown to connect links 9 and 10 to the boot base attachment 4 and the surface engager 3 by fastening hole 5 to hole 5*a*, hole 6 to hole 6*a*, hole 7 to hole 7*a*, and hole 8 to hole 8*a*, respectively. These links and pin joints assure the skate structural integrity while allowing displacements between the boot base attachment 4 and the surface engager 3.

Note that, geometrically, the boot base attachment 4, the surface engager 3, and links 9 and 10 together form the four sides of a parallelogram to assure that the surface engager 3 will always be parallel to the boot base attachment 4. The present invention thus surpasses all prior arts in controlling the surface engager for skate jump/landing.

Wound spring 5*c* is shown to be installed on pin 5*b*, with two spring legs pushing against link 9 and the boot base attachment 4. Similarly, wound spring 8*c* is shown to be installed on pin 8*b*, with two spring legs pushing against link 10 and the top of surface engager 3. In addition, coil spring 11 is connected between pins 6*b* and 7*b*. All three springs will deform and store energy with relative displacements between the boot base attachment 4 and the surface engager 3. (For a simplified design, using any one of the three springs alone can serve the purpose of jump assistance.) An additional wound spring can be provided at each pin joint, if desired, or a single spring (or any combination thereof) at any of the disclosed locations can be used.

Because most of the space between the boot base attachment 4 and the surface engager 3 can be used for skate/spring deformation and energy storage/release, the present invention is therefore very effective for jump assistance. In addition, because all links and spring(s) are located under the boot base attachment 4 without any hazardous protrusions around the boot (such as in the U.S. Pat. No. 5,503,413 to Belogour), the present invention adds safety to performance.

For the stable support of a skater's weight, the front segment of the surface engager 3 is made so long that it extends the front roller axle 12 beyond the boot toe (hole 6) throughout the entire range of skate deformation.

One or more stopper elements (a single stopper element 13 is shown added onto surface engager 3) may be provided to keep links 9 and 10 (through the connection to the surface engager 3) always "forward inclined" such that the boot can only move forward when it is forced downward. Thus, the stopper element 13 reduces uncertainty in the skate for improved control. (The present invention is also applicable to a jump skate with "rearward inclined" links. Nevertheless, a stopper is needed to maintain a rearward incline of the links.)

Finally, the flat top portion of the surface engager 3 serves as an additional stopper that limits the downward rotation of links 9 and 10 and defines the maximal deformation range of the skate.

Figure 2A:
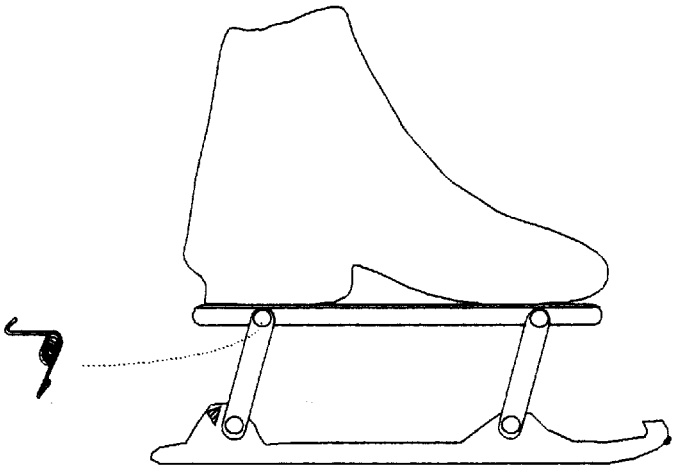
FIGS. 2(*a*) and 2(*b*) illustrate the side and front views, respectively, of the first preferred embodiment of the present invention related to a jump ice skate using one spring.
Figure 2B:
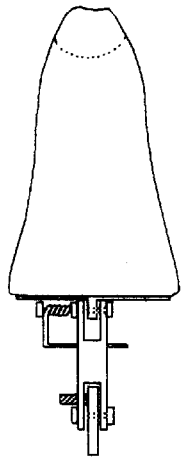
Figure 3A:
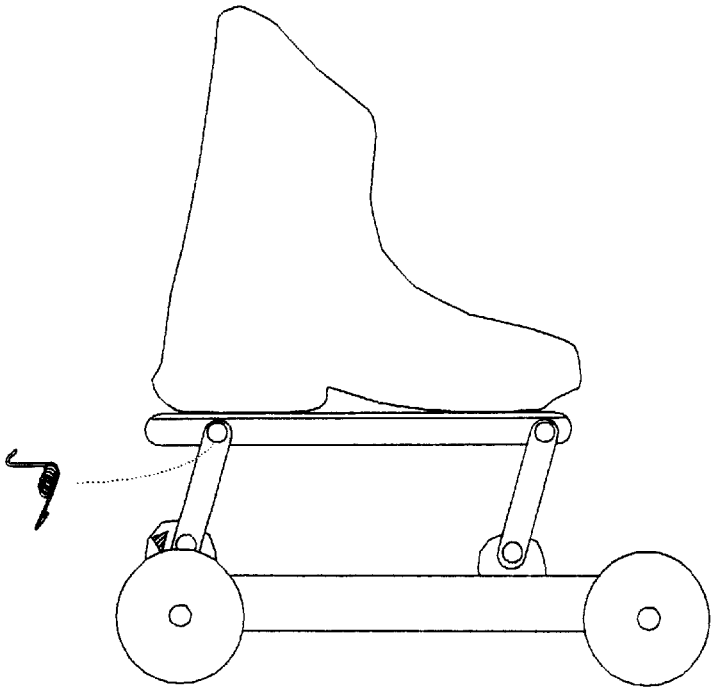
FIGS. 3(*a*) and 3(*b*) illustrate the side and front views, respectively, of the first preferred embodiment of the present invention related to a jump conventional roller skate using one spring.
Figure 3B:
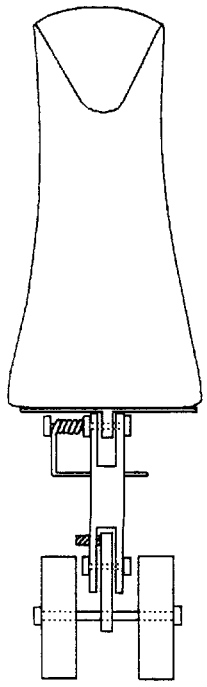

FIGS. 2(*a*) to 2(*b*) illustrate the side and front views, respectively, of the first preferred embodiment of the invention related to a jump ice skate using one spring. FIGS. 3(*a*) to 3(*b*) illustrate the side and front views, respectively, of the first preferred embodiment of the invention related to a jump conventional roller skate using one spring.

2. Second Preferred Embodiment

Figures 4A, 4B:
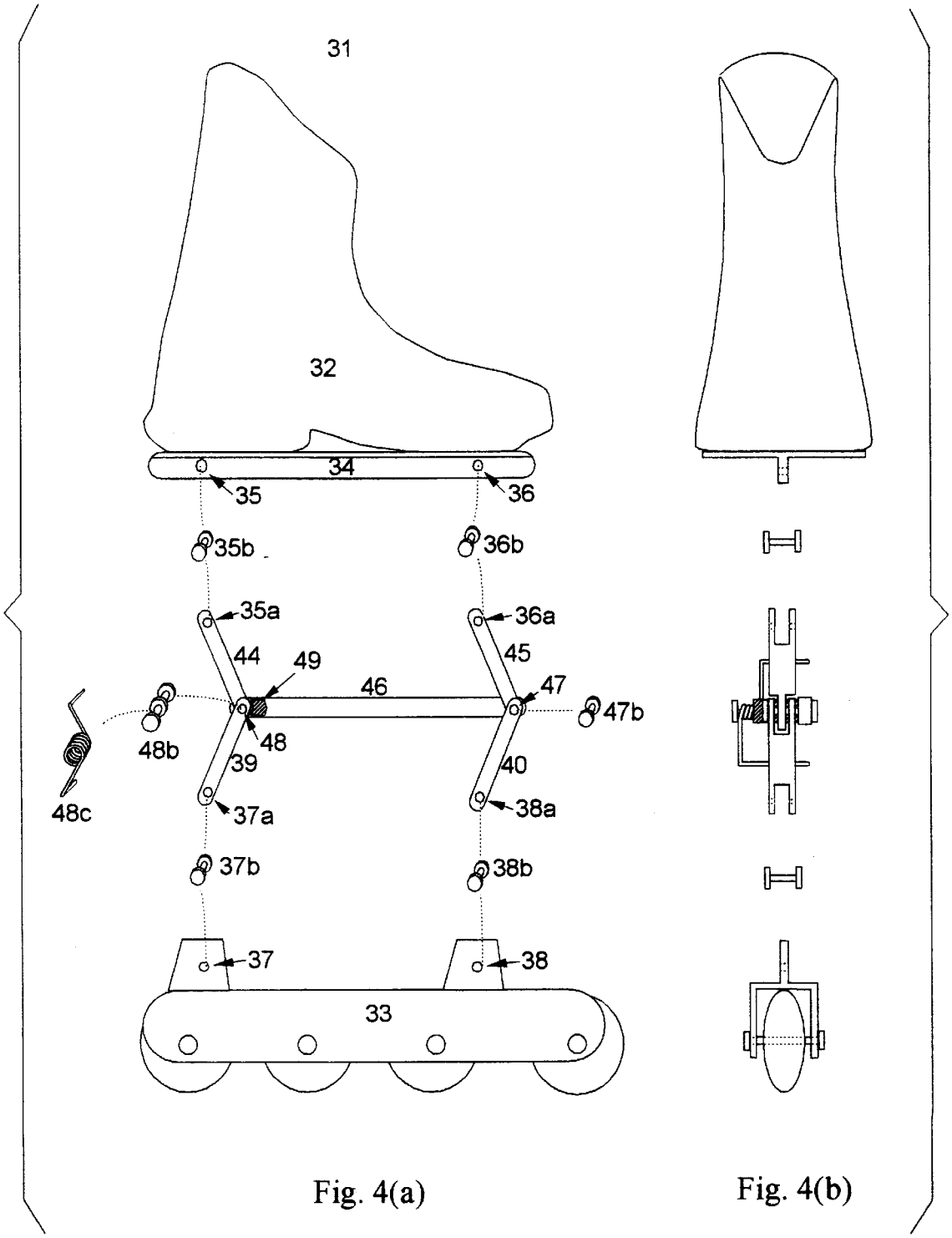
FIGS. 4(*a*) and 4(*b*) are exploded perspectives illustrating the side and front views, respectively, of the second preferred embodiment of the present invention related to a jump in-line roller skate using one spring.
Figure 4C:
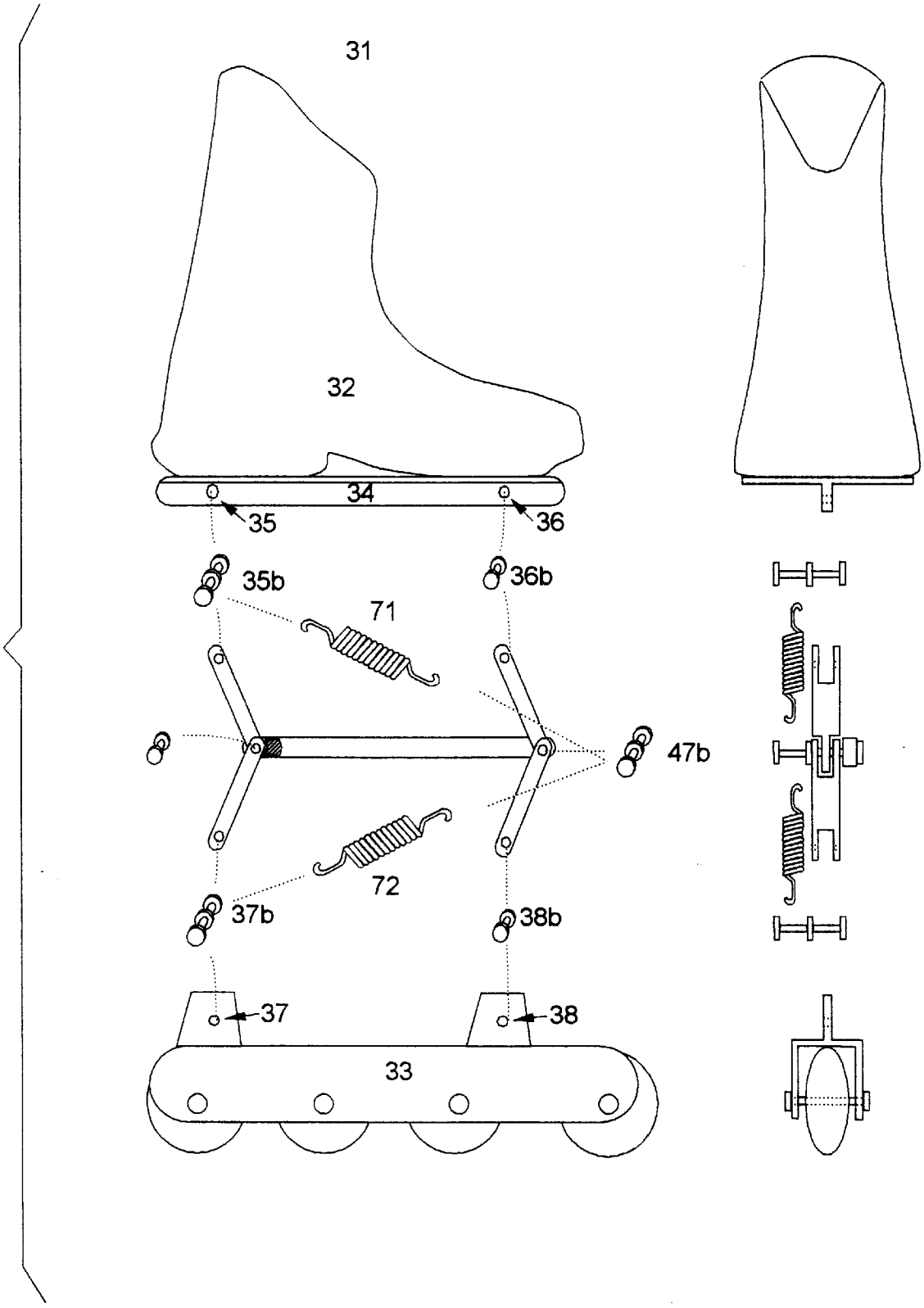
Figure 4D:
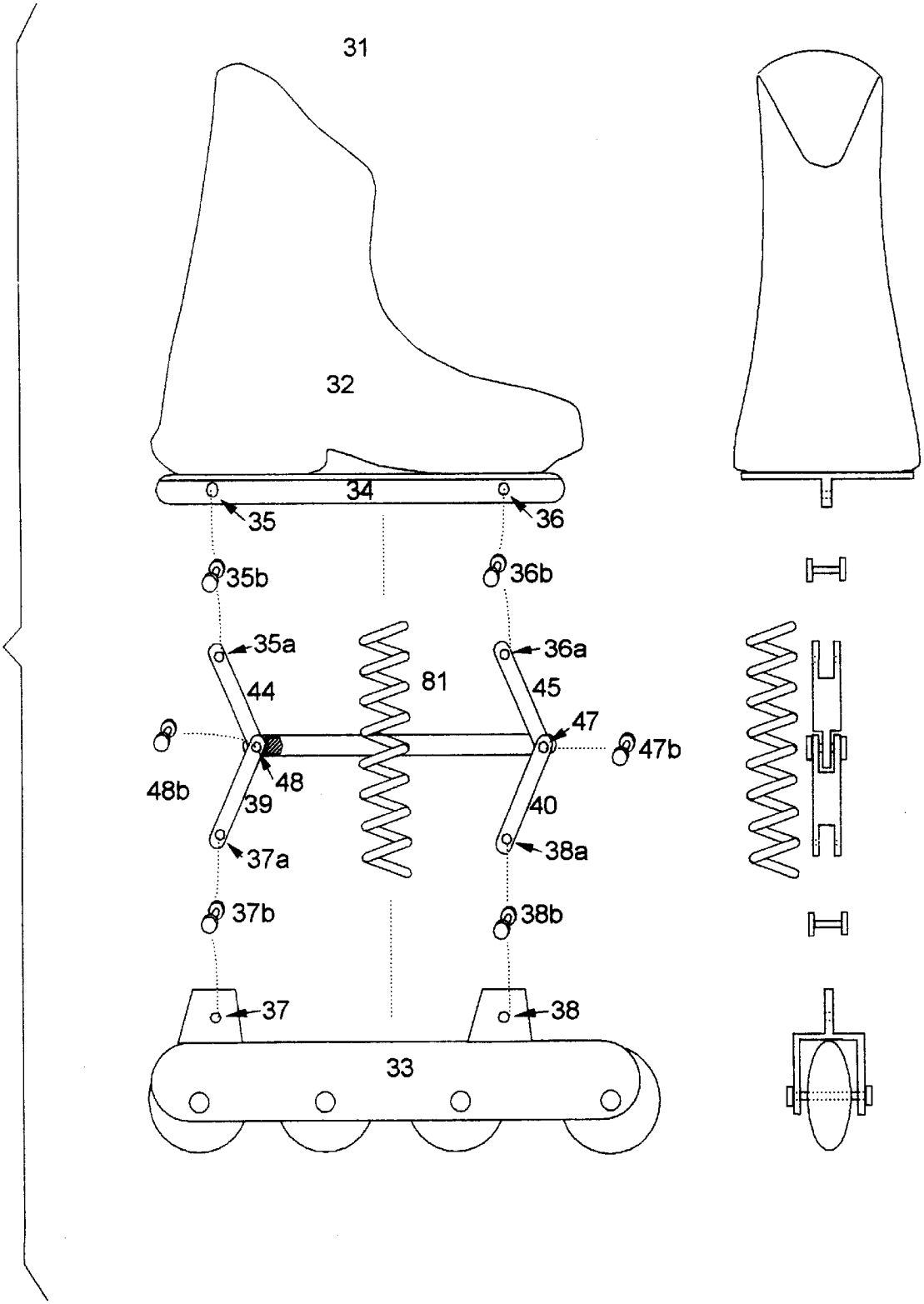

FIGS. 4(*a*)–6(*b*) illustrate a second preferred embodiment of the present invention. In comparison to the first embodiment, the second embodiment minimizes the relative horizontal displacement between the boot and the surface engager, thus offering further control to a jump skate.

As shown in FIGS. 4(*a*) and 4(*b*), jump skate 31 includes a boot 32 and an in-line roller assembly as the surface engager 33. Boot 32 includes a base attachment 34 with two machined holes 35 and 36. Surface engager 33 includes attachments with two machined holes 37 and 38. The distance between holes 35 and 36 is the same as that between holes 37 and 38.

Shown between the boot base attachment 34 and the surface engager 33 is the link/spring mechanism that comprises Links 39, 40, 44, 45, and 46

Pins 35*b*, 36*b*, 37*b*, 38*b*, 47*b*, and 48*b*

Wound spring 48*c*.

Links 39, 40, 44, 45, and 46 are connected by pins 47*b* and 48*b*, through holes 47 and 48. Links 39, 40, 44, and 45 are equal in length, each with an additional machined hole (holes 37*a*, 38*a*, 35*a*, and 36*a*, respectively) for connections to the surface engager 33 and the boot base attachment 34. The center link 46 has a length equal to the distance between holes 35 and 36, which also equals to the distance between holes 37 and 38.

Pins 35*b* and 36*b* are shown to connect links 44 and 45 to the boot base attachment 34 by fastening hole 35 to hole 35*a*, and hole 36 to hole 36*a*, respectively. Similarly, pins 37*b* and 38*b* are shown to connect links 39 and 40 to the surface engager 33 by fastening hole 37 to hole 37*a*, and hole 38 to hole 38*a*, respectively. These links and pin joints assure the skate structural integrity while allowing displacements between the boot and the surface engager.

Note that, geometrically, the boot base attachment 34, the surface engager 33, and all five said links together form two superimposed parallelograms to assure that the surface engager 33 will always be parallel to the boot base attachment 34.

The wound spring 48*c* is shown to be installed on pin 48*b*, with two spring legs pushing against links 39 and 44, which will deform and store energy with relative displacements between the boot base attachment 34 and the surface engager 33. In addition, the deformation of wound spring 48*c* will push forward the center link 46 and suppress relative horizontal displacement between the boot base attachment 34 and the surface engager 33. Additional wound springs can be provided at any of the pin joints, or any combination of such springs can be used. It is preferred, however, that at least one spring be provided for each of the two parallelograms (i.e., on at least one of the pins 35*b*, 36*b*, 47*b*, 48*b* and on at least one of the pins 47*b*, 48*b*, 37*b*, 38*b*) so that neither of the parallelograms can collapse.

In a further modification shown in FIG. 4(*c*), one or both of tension springs 71 and 72, respectively attached between pins 35*b*–47*b* and 37*b*–47*b*, can be used instead of or in combination with any or all of the wound springs 48*c* just described, for a maximum of eight springs according to the present embodiment. Alternatively, a compression spring 81 can be attached between the boot and the surface engager as shown in FIG. 4(*d*), alone or in combination with any of the springs discussed above.

Having eliminated the relative rotation and horizontal displacement between the boot base 34 and the surface engager 33, the present invention thus surpasses all prior arts in controlling the surface engager for skate jump/landing. Because most of the space between the boot base attachment 34 and the surface engager 33 can be used for skate/spring deformation and energy storage/release, the present invention is therefore very effective for jump assistance. In addition, because all links and spring(s) are located under the boot base attachment 34 without any hazardous protrusions around the boot (such as in the U.S. Pat. No. 5,503,413 to Belogour), the present invention adds safety to performance.

One or more stopper elements (a single stopper element 49 is shown added onto the center link 46) may be provided to keep it always "forward shifted" when the boot base 34 is forced down toward the surface engager 33. (The present invention is also applicable to a jump skate with a "rearward shifted" center link. Nevertheless, stopper elements are still needed to maintain a rearward shift of the center link 46.) Finally, the flat portions of the surface engager 33 and the boot base attachment 34 serve as additional stoppers that limit the rotation of links 39, 40, 44, and 45, and define the maximal deformation range of the skate.

Figure 5A:
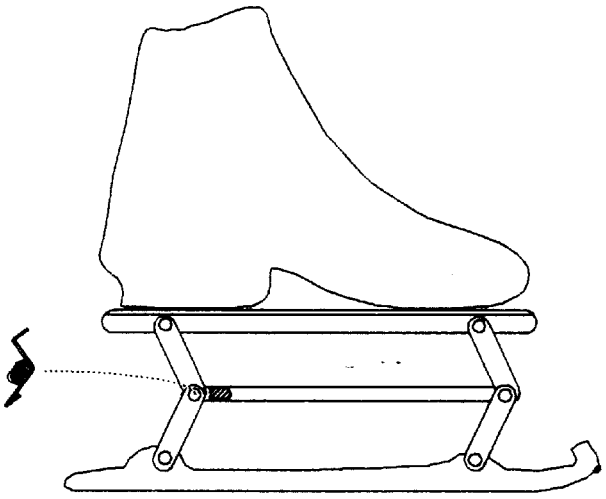
FIGS. 5(*a*) and 5(*b*) illustrate the side and front views, respectively, of the second preferred embodiment of the present invention related to a jump ice skate using one spring.
Figure 5B:
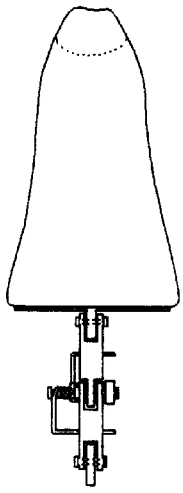
Figure 6A:
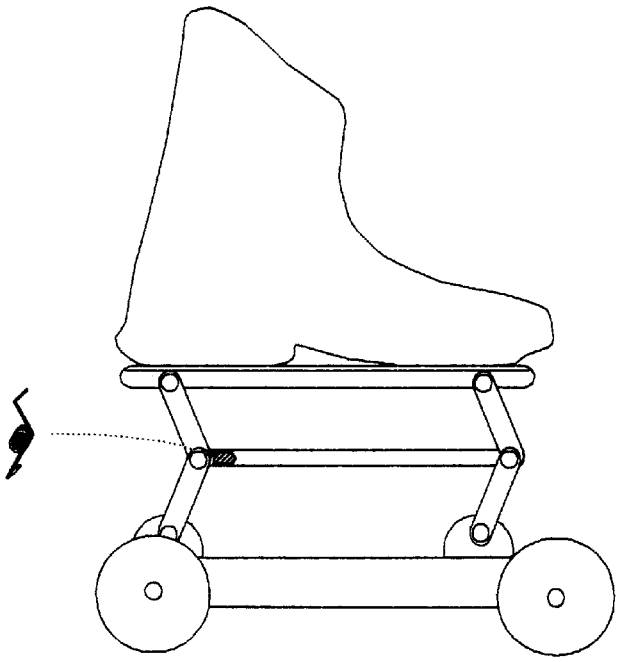
FIGS. 6(*a*) and 6(*b*) illustrate the side and front views, respectively, of the second preferred embodiment of the present invention related to a jump conventional roller skate using one spring.
Figure 6B:
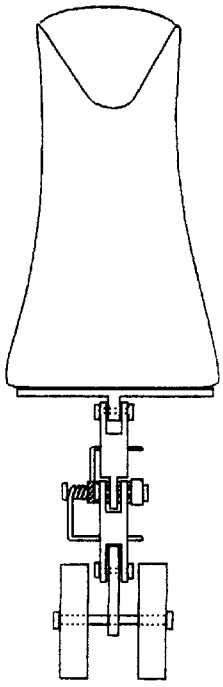

FIGS. 5(*a*) to 5(*b*) illustrate the side and front views, respectively, of the second preferred embodiment of the invention related to a jump ice skate using one spring. FIGS. 6(*a*) to 6(*b*) illustrate the side and front views, respectively, of the second preferred embodiment of the invention related to a jump conventional roller skate using one spring.

3. Integration of Links and Springs

In both preferred embodiments disclosed above, springs can be integrated with links in various ways, depending on the desire to reduce manufacturing and assembling costs in the jump skates. In the following figures, only the in-line roller skate of the first preferred embodiment is used to illustrate an integration of links and springs. Integration of links and springs is, of course, applicable to all jump skates in both preferred embodiments.

Figure 7A:
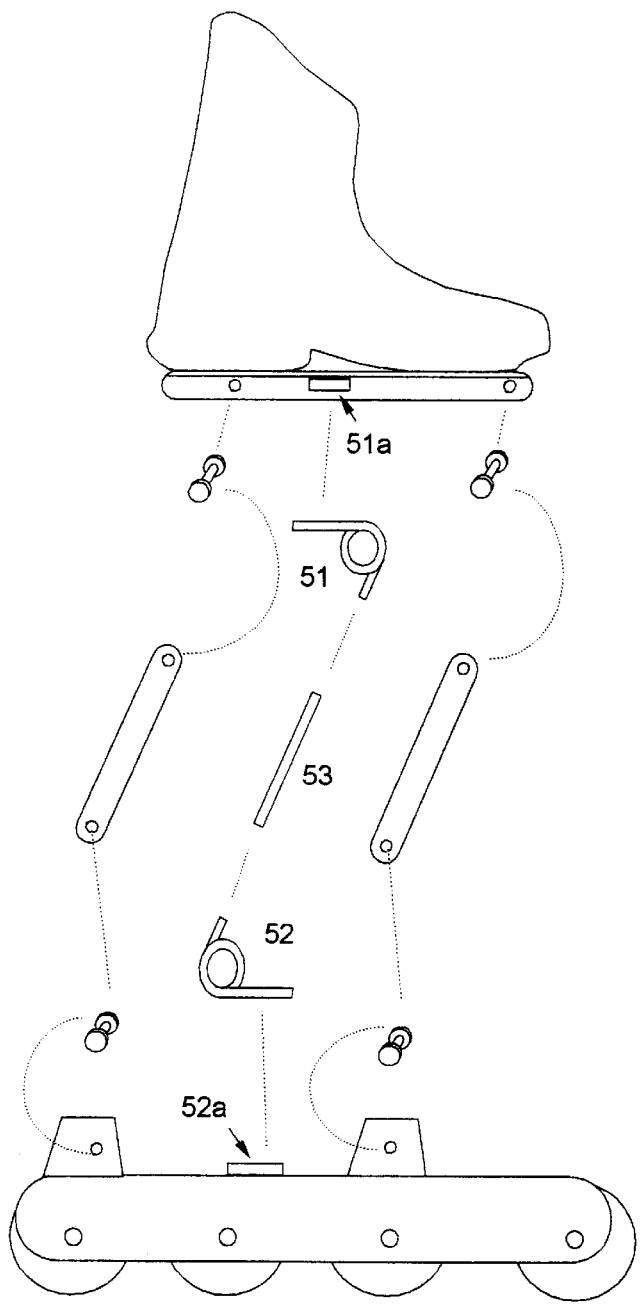
FIGS. 7(*a*) and 7(*b*) are exploded perspectives illustrating the side and front views, respectively, of the first preferred embodiment of the present invention related to a jump in-line roller skate using two springs that are integrated with one of the links.
Figure 7B:
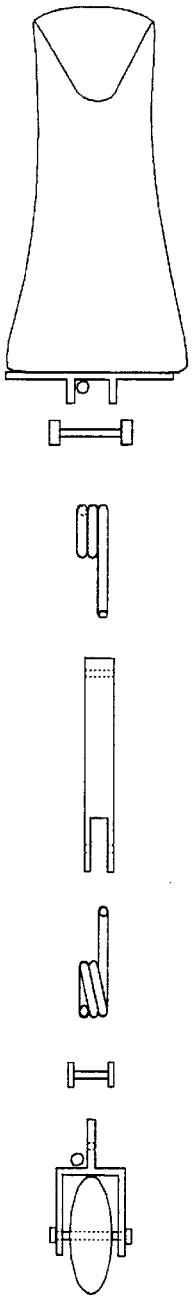

FIGS. 7(*a*) and 7(*b*) are exploded perspectives illustrating the side and front views, respectively, of a jump in-line roller skate using two springs that are integrated with one of the links. Shown between the boot base attachment and the surface engager is a link/spring mechanism comprising three links and two wound springs. Wound spring 51 has one leg installed into ring 51*a* and the other leg integrated (by welding or by any other suitable method, including a one-piece manufacture) with link 53. Similarly, wound spring 52 has one leg installed into ring 52*a* and the other leg integrated with link 53. The locations and attachments of the springs to the boot and the surface engager are illustrative only, and may differ without departing from the teachings of the invention.

Note that the length of link 53 may not equal to that of the other two "stand-alone" links. However, the overall height of the integrated link/spring part should be comparable to that of the stand-alone links.

Figure 8A:
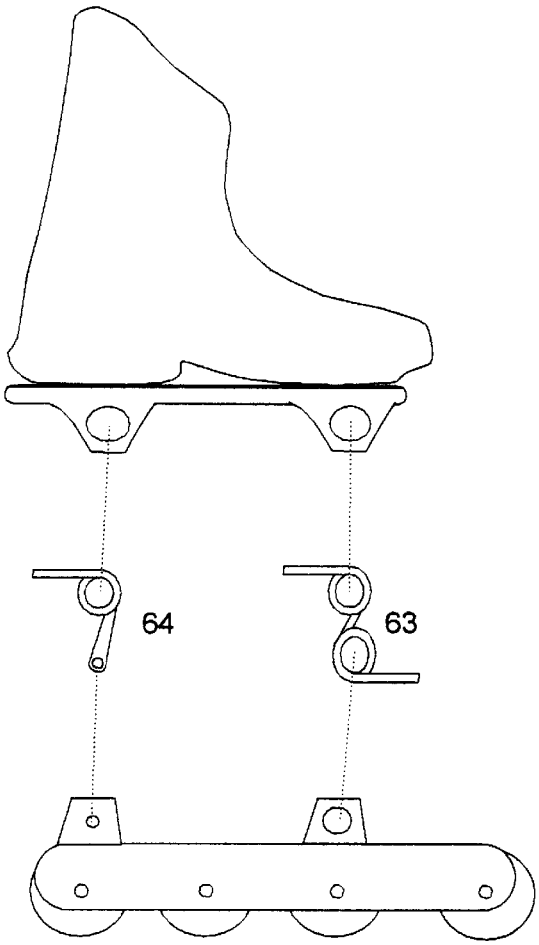
FIGS. 8(*a*) and 8(*b*) are exploded perspectives illustrating the side and front views, respectively, of the first preferred embodiment of the present invention related to a jump in-line roller skate using three springs that are all integrated with the links.
Figure 8B:
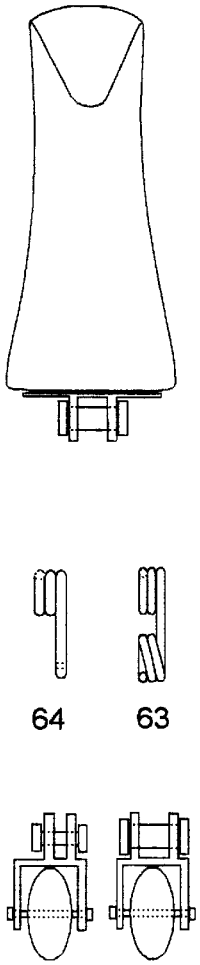

FIGS. 8(*a*) and 8(*b*) are exploded perspectives illustrating the side and front views, respectively, of a jump in-line roller skate using three springs that are all integrated with the links. Part 63 represents a link integrated with two wound springs. Part 64 represents a link integrated with just one wound spring. Another part 63 can be used instead of part 64, however, and another part 64 can be used in place of part 63. The empty (without a spring) end of the link in part 64 is connected to the surface engager with a relative small pin joint. In these two figures, all wound springs are shown connected to the boot base and surface engager with pin joints, but these connections represent preferred arrangements and do not limit the invention.

The invention therefore provides a novel and improved skate that allows quick storage/release of large amounts of energy and enables a skater to jump higher into the air and to land more comfortably than when wearing a regular skate.

It is to be understood that the form of the invention herein shown and described is to be taken as the preferred embodiments thereof, and that various changes in shape, material, size, and arrangement of parts may be resorted to without departing from the spirit or the invention or scope of the subjoined claims. For example, plural similar link/spring mechanisms may be transversely provided in any of the embodiments. Further, the pivot connections are not limited to pin joints, but may incorporate ball bearings or any other suitable joint that permits the functionality of the embodiments described above. Additionally, one or more stopper elements may be provided in any of the illustrated embodiments.

I claim:

1. A jump skate for permitting a skater to perform jumping maneuvers, comprising:

a boot;

a surface engager having a ground traversing lower portion;

a forward link and a rearward link, the forward link having an upper end portion pivotally connected at a forward portion of the bottom of the boot at a first pivot connection, and a lower end portion pivotally connected at a forward portion of the surface engager at a second pivot connection, and the rearward link having an upper end portion pivotally connected at a rearward portion of the bottom of the boot at a third pivot connection, and a lower end portion pivotally connected at a rearward portion of the surface engager at a fourth pivot connection; and a wound spring operationally attached at at least one of the first through fourth pivot connections so as to bias the boot in a direction away from the surface engager by virtue of a torque exerted by the wound spring, the wound spring having a characteristic of quick storage/release of energy through a torque-wise deformation/recovery thereof, to assist a jump.

2. The jump skate of claim 1, wherein the ground traversing lower portion of the surface engager includes a plurality of wheels rotatably supported in an in-line configuration.

3. The jump skate of claim 1, wherein the ground traversing lower portion of the surface engager includes a first pair of roller skate wheels rotatably supported by a first axle transverse to the longitudinal axis of the skate, and a second pair of roller skate wheels rotatably supported by a second axle transverse to the longitudinal axis of the skate and disposed rearwardly of the first pair of roller skate wheels.

4. The jump skate of claim 1, wherein the ground traversing lower portion of the surface engager includes an ice skating blade that extends in the direction of the longitudinal axis of the skate.

5. The jump skate of claim 1, further comprising:

a base attachment attached to the bottom of the boot, wherein the first pivot connection comprises a first pin connecting the upper end portion of the forward link to a forward portion of the base attachment, the second pivot connection comprises a second pin connecting the lower end portion of the forward link to the forward portion of the surface engager, the third pivot connection comprises a third pin connecting the upper end portion of the rearward link to a rearward portion of the base attachment, and the fourth pivot connection comprises a fourth pin connecting the lower end portion of the rearward link to the rearward portion of the surface engager.

6. The jump skate of claim 1, wherein the first, second, third, and fourth pivot connections constitute the four apices of a parallelogram.

7. The jump skate of claim 1, further comprising a stopper element arranged to permit the jump skate to only move forward when forced downward against the spring force of the spring.

8. The jump skate of claim 7, wherein the stopper element is fixed to the rearward portion of the surface engager.

9. The jump skate of claim 1, wherein the spring has a first end attached at the first pivot connection and a second end attached at the fourth pivot connection.

* * * * *